United States Patent [19]

Engstrom

[11] 4,008,026

[45] Feb. 15, 1977

[54] CONCRETE FORMING APPARATUS FOR MAKING FENCE POSTS AND THE LIKE

[76] Inventor: William J. Engstrom, 5608 E. 96th, Puyallup, Wash. 98381

[22] Filed: Apr. 25, 1975

[21] Appl. No.: 571,856

[52] U.S. Cl. ..... 425/117; 249/94; 249/168; 425/454

[51] Int. Cl.[2] ..... B28B 1/08; B28B 5/04; B28B 23/18

[58] Field of Search ... 425/453, 454, 455, DIG. 200, 425/DIG. 201, 117; 249/120, 121, 143, 154, 164, 165, 166, 167, 168, 94; 266/13; 164/323, 324, 329; 104/131, 252, 255, 256

[56] References Cited

UNITED STATES PATENTS

| | | | |
|---|---|---|---|
| 404,381 | 6/1889 | Clark | 249/166 |
| 1,045,028 | 11/1912 | Hicks | 249/143 X |
| 1,109,389 | 9/1914 | Baum | 249/166 X |
| 1,402,558 | 1/1922 | Weber | 425/455 X |
| 1,550,140 | 8/1925 | Bennington | 104/131 X |
| 2,601,199 | 6/1952 | Zabel | 164/323 X |
| 2,903,777 | 9/1959 | Mitchell | 249/167 X |
| 2,953,262 | 9/1960 | Murphy | 104/131 X |
| 3,318,261 | 5/1967 | Garcia | 104/131 X |
| 3,344,492 | 10/1967 | Eggeling | 425/455 X |
| 3,506,755 | 4/1970 | Rudder | 425/DIG. 201 |
| 3,786,857 | 1/1974 | Sutherland | 164/350 |

*Primary Examiner*—Francis S. Husar
*Assistant Examiner*—John McQuade
*Attorney, Agent, or Firm*—Eugene D. Farley

[57] ABSTRACT

A mold and associated apparatus for the vertical forming of concrete fence posts. The mold has integral sides which are not opened for removal of the finished post. The apparatus provides a track and mold support means for a continuous casting operation.

3 Claims, 11 Drawing Figures

3
56
60
62
54
70
72
4
66
68
24
36
104
22
92
90
86
88
84
82
49
47
46
44
40
42
38
43
48
50
52
5

CONCRETE FORMING APPARATUS FOR MAKING FENCE POSTS AND THE LIKE

BACKGROUND OF THE INVENTION

This invention relates to apparatus for the forming of fence posts, particularly from concrete casting material. It relates particularly to the forms employed in such apparatus.

Due to the increased cost of lumber, it has become increasingly desirable to fabricate fence posts from non-wood materials. Reinforced concrete provides a particularly suitable material for this purpose. It is impervious to weathering, resists deterioration from the soil bacteria which limit the life of wood posts, has high strength, and gives an aesthetically pleasing appearance. The primary problem with concrete fence posts in the past has been in devising forming means to fabricate an adequate supply at a low cost.

The desirable orientation of molds in which concrete posts are cast is vertical. Firstly, vertical orientation takes up less space than horizontal orientation. Secondly, vertical molds allow the weight of the plastic casting material to compact and settle the cement aggregate, giving a stronger product with a finer surface finish.

The prior art molds, however, have generally been designed for horizontal casting. This has been due to the obvious problems associated with filling and transporting heavy vertical molds. This is especially true if an assembly line forming operation is desired wherein the molds are moved from station to station during the forming operation.

In addition, most of the prior art molds have had one or more of their side walls removable for emptying of the mold. This increases the difficulty of vertical assembly-line forming and allows a high rate of water evaporation from the mold during the curing stage.

Accordingly, the general object of the present invention is to provide an apparatus for vertical forming of fence posts.

It is a further object of the present invention to provide such an apparatus having a horizontal track suspended to allow free access underneath.

It is a further object of the present invention to provide such an apparatus having molds vertically carried by the track for casting of the fence posts.

It is a further object of the present invention that the molds comprise an elongate tube open at both ends.

It is a further object of the present invention to provide mold support means to suspend the molds from the track and allow transportation of the molds from station to station on the track.

It is a further object of the present invention that the mold support means be removable from the track.

THE DRAWINGS

The manner in which the foregoing and other objects of the invention are accomplished will be apparent from the accompanying specification and claims, considered together with the drawings wherein:

GENERAL STATEMENT OF THE INVENTION

The present invention generally provides an apparatus for the vertical forming of concrete fence posts.

More particularly, the invention includes a horizontal track suspended in a manner to allow free access beneath the track. Forms, for casting of the fence posts, are carried by the track and are movable along the track.

Form support means roll on the track and releasably join the molds to suspend the molds from the track.

DETAILED DESCRIPTION OF A PREFERRED EMBODIMENT

Figures 1, 6, 7, 8, 9, 10, 11:
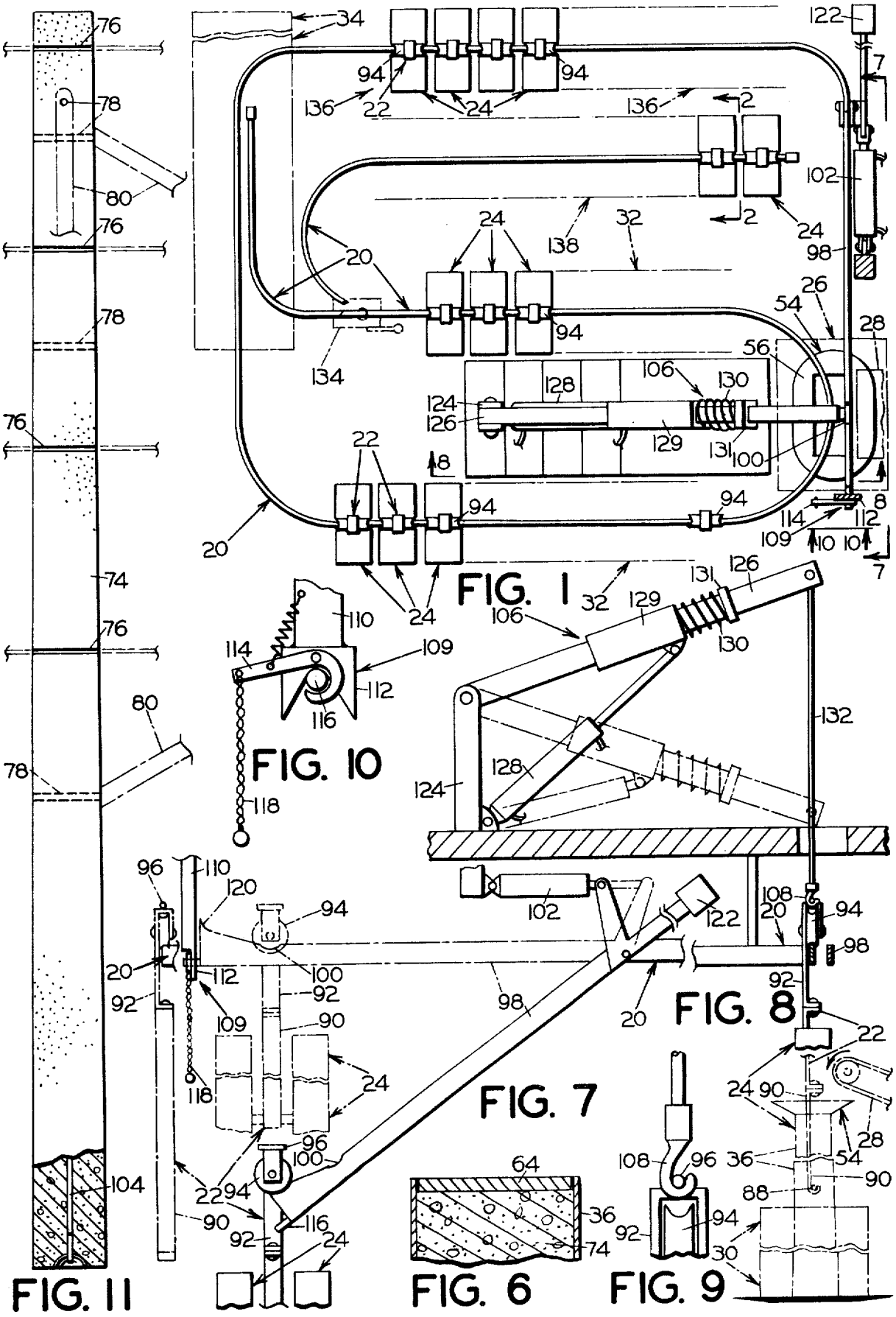
FIG. 1 is a diagramatic plan view of a typical installation utilizing the assembly of the present invention.
FIG. 6 is a sectional, detailed view showing the top portion of the mold when filled with casting material.
FIG. 7 is a fragmented view, in elevation, looking in the direction of the arrows of line 7—7 of FIG. 1.
FIG. 8 is a fragmented view, in elevation, looking in the direction of the arrows of line 8—8 of FIG. 1.
FIG. 9 is a fragmented view, in elevation, of a lifting hook used in the invention.
FIG. 10 is a fragmented view, in elevation, looking in the direction of the arrows of line 10—10 of FIG. 1.
FIG. 11 is a view, in elevation, partially broken away, showing the finished post provided by the present invention.

FIG. 1 diagrammatically shows a typical installation utilizing the assembly of the present invention. In general, the assembly comprises track 20 carrying thereon mold support means 22 and elongate molds 24.

The invention will normally be used in an installation such as shown in FIG. 1. Mold filling station 26 includes conveyor belt 28 which transports the plastic casting material to the molds, and filling machine 30 which positions and vibrates the molds while they are being filled. Concrete curing station 32 is provided to maintain the filled molds in their vertical orientation while the casting material sets. Post removal station 34 provides the necessary equipment to remove the finished posts from the molds and prepare the molds for the next filling cycle.

Figures 2, 3, 4, 5:
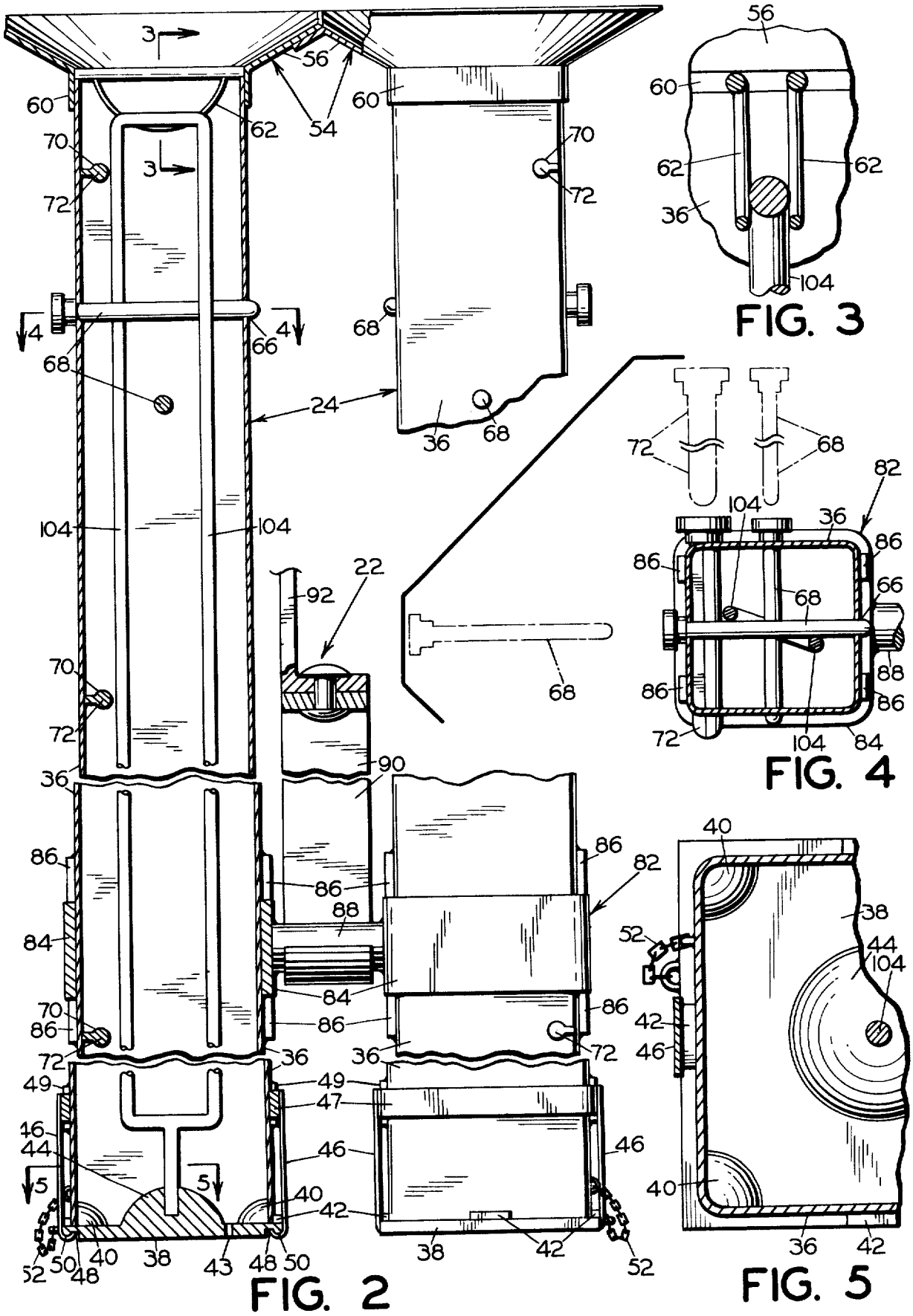
FIG. 2 is a fragmentary side elevation, foreshortened, and partially broken away, looking in the direction of the arrows of line 2—2 of FIG. 1.
FIG. 3 is a fragmentary, sectional view in elevation of the mold taken along line 3—3 of FIG. 2.
FIG. 4 is a transverse, sectional view of the mold taken along line 4—4 of FIG. 2.
FIG. 5 is a fragmented, transverse, sectional view of the mold looking in the direction of the arrows of line 5—5 of FIG. 2.

Referring now to FIG. 2, mold 24 generally comprises a box framework rectangular in cross section. Tube 36 forms the periphery of the mold and extends the entire length of the desired post. Tube 36 has trapezoidal sides with the lower portion slightly wider than the top, providing a tapered mold to facilitate removal of the posts.

I have found that a mold 3-½ inches square at the top and 4 inches square at the bottom works best for a standard 6-foot post. However, other shapes and sizes could be used, depending upon the particular application. It is desirable that the tube sides be absolutely straight and square in order to facilitate proper post removal. In this regard, the tube is shown with the four sides fabricated as an integral unit.

Bottom cap 38 covers the lower open end of mold 24 during the casting operation. The cap includes a flat square plate slightly larger than the cross-sectional dimensions of the mold. Raised locating pads 40 at each corner of bottom cap 38 are positioned to fit within the mold, and tabs 42 at each side fit outside the mold, thus preventing lateral movement of the cap when installed.

Drainage hole 43 is placed through the cap. Dome 44, medially positioned in cap 38, forms a concave opening at the bottom of the finished post. This opening aids in leveling of the finished post. Centered reinforcing rod locating means, such as a hole, are provided in dome 44 to position and retain a loop of reinforcing rod in the mold during filling.

Bottom cap 38 is releasably joined to mold 24 by spring clips 46 mounted on collar 47, which is joined to tube 36 through tabs 49 tack welded to the corners of the tube. Recesses 48 with depending nubs 50 are located on the sides of bottom cap 38 to engage spring clips 46. Chain 52 is fastened to bottom cap 38 on one end, and to mold 24 on the other end to prevent misplacing the cap when it is removed.

Funnel-shaped top cap 54 releasably fits over the upper open end of the mold to aid in filling it with the casting material. Top cap 54 comprises outwardly angled top portion 56 and slightly longer downward depending sleeve 60. Sleeve 60 is dimensioned to fit over the top open end of tube 36.

I show top portion 56 formed with a shallow angle. This gives a large opening in which to pour the casting material without requiring undue height. If the molds are vibrated during filling, as is necessary if the casting material is plastic concrete, this shallow angle does not impede filling.

Attached to the lower surface of top cap 54 are paired U-shaped reinforcing rod locating clips 62. They depend downwardly into the mold in order to locate and maintain the top portion of a loop of reinforcing rod in the mold during filling. The top cap is removed from the mold before the casting material sets in order to prevent permanent encasement of clips 62.

Push pad 64 is positioned in the mold after it has been filled. As shown in FIG. 6, push pad 64 includes a flat plate dimensioned to fit into the top of the mold after it has been filled. The push pad slightly compresses the top portion of the plastic casting material due to vibration of the mold, and provides a smooth square top surface on the finished post. Also, the push pad seals the top of the mold during curing to prevent rapid evaporation of water from the casting material.

Paired circular openings 66 are positioned in the medial portion of opposed sides of tube 36 at selected locations. These are dimensioned to receive support hole pins 68 during the casting operation, as shown in FIG. 4. Paired key-shaped openings 70 are positioned off-center at selected locations in opposed sides of tube 36. It will be seen in FIG. 2 that the ends of openings 70 are adjacent the sides of tube 36. These are dimensioned to receive wire slot pins 72 during the casting operation. Thus, the resulting wire slot is open on one side of the post.

The locations of these various openings in the mold are best shown in FIG. 11 which displays finished post 74. The four wire slots 76 formed by wire slot pins 72 are substantially equally spaced and located on one side of the upper two-thirds of the post; the bottom one-third generally being below ground. It will be noted that due to the off-centered location of the key-shaped wire slot pins against one of the tube sides, the resulting slots are open.

Support holes 78 are located through the center of post 74. I propose three such holes in one direction and one hole in a direction 90 degrees opposed. Again referring to FIG. 11, two of the holes are at the top of the post, one is located near the ground line, and one is medially positioned. The function of support holes 78 is to hold support bars 80 which are used to maintain plumb orientation of the posts. The support bars are primarily used on corner posts for this purpose, thus, the support bars run diagonally from the support holes on both sides of the top of a corner post to the lower support holes in each post adjacent the corner post.

In the vertical casting techniques made possible with the instant invention, two of the above described molds are generally joined together by lifting bar means 82 which also serves as the attachment component of mold support means 22.

Lifting bar means 82, shown in FIG. 2, comprises a pair of collars 84 dimensioned to fit over tubes 36, locating tabs 86, one adjacent each corner of the collars, and lifting rod 88 interconnecting the two collars. The lifting bar means is assembled before insertion of the tubes. Lifting rod 88 is rigidly secured to the sleeves, as by welding, to form a substantially integral assembly.

The lifting bar means is then installed on the tubes and locating tabs 86 are tack welded to the tube sides above and below the sleeves to maintain the sleeves on the tube. Care must be taken in forming this weld not to overly heat the form, thus causing distortion of the tubes. It is for this reason that the lifting bar means is itself not welded to the tube. The tabs are only tack welded at the tube corners where the possibility of warping is minimized.

Mold support means 22 is provided to suspend the molds from the track and transport them between the stations. As shown in FIGS. 7 and 8, mold support means 22 includes elongate hanger bar 90, having a hook at its lower portion and pivotably joined at its upper end to pulley bar 92. The hanger bar hook is configured to fit about lifting rod 88 interconnecting a pair of molds 24. Thus the paired molds can be carried by the mold support means.

Pulley bar 92 is pivotably joined at its lower end with hanger bar 90. The upper end carries flanged wheel 94 for rolling engagement on track 20. Positioned on the upper extremity of pulley bar 92, lug 96 protrudes from each end for remote lifting of the lifting bar means.

The particular joinder means, whereby the lifting bar means engages the mold slightly above its center of gravity, allows the form to be pivoted about a horizontal axis. This provides the operator access to either end of the mold at any stage of operation. In addition, the pivotable joinder of pulley bar 92 and hanger bar 90 allows rotation of the molds about their vertical axis.

Referring now in detail to FIGS. 7 and 8, it will there be seen that one section of track 20 is hinged to allow it to be placed in either a raised or lowered position. Hinged section 98 of track 20 is located above filling machine 30. Hinged section 98 defines first detent means 100 near its displaced end and second detent means 120 immediately inwardly adjacent its displaced end. The detent means are configured to engage and locate wheel 94 of the mold support means. Counterweight 122 at the hinged end of hinged section 98 is provided to reposition the track in its raised position after the molds have been removed. Hinged section 98 of the track is latched in its raised position by latch 109.

Latch 109, shown in FIG. 10, comprises suspended latch support 110, depending guide 112 and retaining hook 114. Retaining hook 114 engages post 116 joined to the displaced end of hinged section 98 in order to lock the track in its raised position. Latch 109 is released by deployment of chain 118 mounted on the end of retaining hook 114, which rotates the hook causing release of post 116. Hydraulic dampening means including cylinder 102 are joined to hinged section 98 for slow, smooth displacement of the hinged section to its lowered position.

Lifting hoist 106, which is shown mounted on the roof of the facility is used to position the hinged section in its raised position. Lifting hoist generally comprises upright 124, arm 126 and hydraulic cylinder 128. Hydraulic cylinder 128 is pivotably attached to the lower portion of upright 124 and attached to arm 126 by sliding sleeve 129. Shock absorber 130 mounted outwardly the end of sliding sleeve 129 cushions the supported mold in the event of uneven operation of the lifting hoist by engagement with stop 131. Arm 126 is pivotably mounted on one end to the upper portion of upright 124. Cable 132 depends from the other end of arm 126 to bifurcated hook 108, which engages lug 96 on the form support means.

OPERATION

Having thus described the particular molds utilized in the invention, the manner of its use will be more readily apparent.

In the first instance, a plurality of molds are constructed and interconnected in pairs as described in the foregoing and shown in the accompanying drawings. Track assembly 20 is suspended to provide free access below its path for suspension of the molds. The particular layout of the track is unimportant, however it must pass through the aforementioned stations. I have found that a semiclosed-looped track, as shown in FIG. 1, best serves the purposes of the instant invention. This type of track allows for maximum operation of the forming assembly in a batch pour operation.

It would be possible, however, to arrange the track to provide a completely closed loop for continuous operation. This would be desirable in large forming facilities.

Preparatory to engagement of the molds on the track, bottom caps 38 are secured on molds 24 and the molds are sprayed with a parting agent. Pre-formed loops of reinforcing rod 104, shown in FIG. 1, are installed. The lower portion of the rods are centered and retained by holes in dome 44 of the bottom caps. Support hole pins 68 and wire slot pins 72 are installed in their respective openings. It will be noted in FIG. 2 and 4 that the topmost support hole pins fit between the reinforcing rod loops without interference. The rods are pre-formed to allow insertion of the pins without interference.

Starting at the removal station with prepared, empty molds engaged on track 20 by mold support means 22, the molds are moved either manually or by powered means to filling station 26.

When wheel 94 is situated in first detent means 100 of the hinged section of track, as shown by the phantom lines in FIG. 7, hinged section 98 is lowered by release of latch 109.

Upon displacement of the hinged section of track, wheel 94 rolls to second detent means 120 to position molds 24 in the filling machine as shown by the solid lines of FIG. 7. Mold support means 22 is then removed from the track and hinged section 98 is placed in its raised position. The form support means is repositioned on the track and moved down the track clear of the filling station, as shown in FIG. 8.

Funnel top caps 54 are installed on the top of the molds. Reinforcing rod locating clips 62 are positioned over the top portion of the reinforcing rod loops to center and maintain them during filling.

Casting material is then moved up conveyor belt 28 into molds 24 through funnel top caps 54 until the molds are nearly filled. Top caps 54 are removed, the plastic casting material now prevents displacement of the reinforcing rods, and the molds are manually filled to within a short distance of their top. Push pads 64 are then installed on top of the molds.

During the filling operation, which takes two to three minutes, the filling machine vibrates to settle and compact the plastic casting material. This provides posts of uniform density having smooth sidewalls. One of the major advantages of vertical filling is that the weight of the column of casting material under the vibration provides greater compaction than that found with horizontal molds.

After filling of the molds, mold support means 22 is returned to the filling station, removed from the track, and attached to the molds. The filled molds are then repositioned on the track by lifting hoist 106.

After the molds are repositioned on the track, they are translated to concrete curing stations 32 to allow the casting material to set. Pins 68, 70 must be removed as soon as is possible without the casting material flowing into their voids. This procedure prevents precipitation of cement onto their surfaces.

The curing operation is a critical stage of the formation process. At this stage, the molds being one piece with little or no openings, prevent evaporation of water, which is essential to the cure.

As one pair of molds is moved into the curing station, a subsequent pair is translated to the filling station to be filled; thus, the continuous operation of the track system of my present invention provides for efficient processing without any needless time loss between the various operations.

After the posts have been cured, the molds are moved to the removal station where the posts are removed. The molds are then prepared for use in another cycle.

The empty molds can be stored on the track in storage station 136. Auxiliary storage station 138 can be utilized, if necessary, by operation of track switch 134.

Having thus described my invention in specific embodiment, I claim:

1. A mold for vertical forming of concrete fence posts comprising:

a. an elongate tube which is rectangular cross-sectioned, open at each end and slightly downwardly flared, b. a bottom cap, in releasable engagement with the lower extremity of the tube having a raised center portion defining centered reinforcing rod locating means and fluid drainage means, c. means releasably securing the bottom cap to the tube, d. funnel-shaped top cap in releasable engagement with the upper extremity of the tube having paired, depending, centered, U-shaped reinforcing rod locating clips, e. the tube having plural, paired, centered, circular openings for insertion of support hole pins and plural, paired, off-centered key shaped openings for insertion of wire slot pins.

2. An apparatus for vertical forming of concrete fence posts comprising in combination:

a. a horizontal track having:

1. at least one hinged section to allow positioning of the hinged section between raised and lowered positions
2. latching means to latch the hinged section in the raised position,
3. dampening means connected to the hinged section for smooth displacement of the hinged section to its lowered position,
4. at least one detent means in the hinged section positioned to locate mold support means when the hinged section is in its lowered position, b. means suspending the track in a manner to allow free access therebeneath, c. molds for casting of the fence posts, carried by the track, each mold comprising:

1. an elongate tube which is rectangular cross-sectioned, opened at each end and slightly downwardly flared,
2. a bottom cap, in releasable engagement with the lower extremity of the tube having a raised center portion defining centered reinforcing rod locating means and fluid drainage means,
3. means releasably securing the bottom cap to the tube,
4. a funnel-shaped top cap in releasable engagement with the upper extremity of the tube having paired, depending, centered, U-shaped reinforcing rod locating clips,
5. the tube having plural, paired, centered, circular openings for insertion of support hole pins and plural, paired, off-centered key shaped openings for insertion of wire slot pins, d. mold support means suspending the molds from the track and allowing translation therealong, 1. provided with hook means in engagement with the molds and
2. configured for releasable engagement with the track.

3. Apparatus for the vertical forming of concrete posts, comprising:

a. a horizontal track, b. means suspending the track in a manner to allow free access therebeneath, c. molds for casting of the posts, carried by the track, each mold comprising:

1. an elongated tube which is rectangular in cross section, open at each end and slightly downwardly flared,
2. a bottom cap in releasable engagement with the lower extremity of the tube having a raised center portion defining centered reinforcing rod locating means and fluid drainage means,
3. means releasably securing the bottom cap to the tube, and
4. a funnel-shaped top cap in releasable engagement with the upper extremity of the tube having paired, depending, centered, U-shaped reinforcing rod locating clips,
5. the tube having plural, paired, centered, circular openings for insertion of support hole pins and plural, paired, off-centered key-shaped openings for insertion of wire slot pins.

* * * * *